United States Patent [19]

McHenney et al.

[11] 4,280,748

[45] Jul. 28, 1981

[54] FUSIBLE TERMINAL

[75] Inventors: John R. McHenney, Fort Wayne; Marlin A. Knowles, Poneto, both of Ind.

[73] Assignee: International Harvester Company, Chicago, Ill.

[21] Appl. No.: 96,110

[22] Filed: Nov. 20, 1979

[51] Int. Cl.[3] ..... H01R 13/08

[52] U.S. Cl. ..... 339/147 R; 339/223 R; 339/276 T

[58] Field of Search ..... 339/147 R, 147 C, 147 P, 339/276 T, 223 R; 339/276 R, 276 S, 276 T, 113 R, 113 L

[56] References Cited

U.S. PATENT DOCUMENTS

| | | | |
|---|---|---|---|
| 4,199,214 | 4/1980 | Pearce et al. | 339/147 P |
| 4,218,109 | 8/1980 | Kneusels | 339/147 R |

*Primary Examiner*—Eugene F. Desmond

*Attorney, Agent, or Firm*—Raymond E. Parks; Frederick J. Krubel; F. David AuBuchon

[57] ABSTRACT

A fusible terminal device for protecting electrical cable networks from detrimental effects of overloads.

4 Claims, 4 Drawing Figures

FUSIBLE TERMINAL

Figure 1:
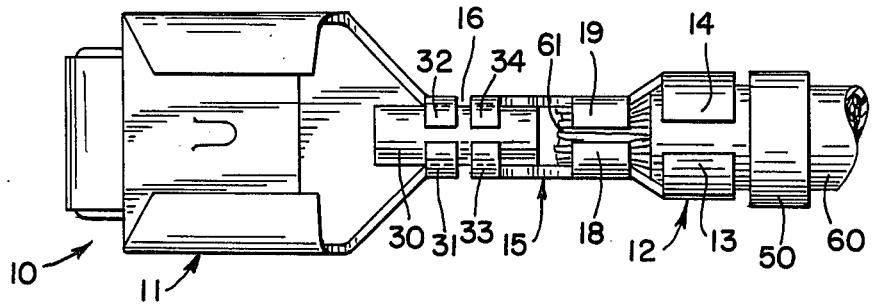

Heretofore, in the motor vehicle industry, the electrical wiring practice was to utilize fusible links to guard against improper wiring and to provide protection to the harness supporting the fusible links. Should a circuit, at the energization of the cable network, by the installation of a battery in the vehicle, be wired with a cable of improper gauge, which is still of a size sufficient to carry a minimum overload without damage to the cable insulation, the fusible link, which usually has a length of approximately 18 mm or 6 inches and has a cross-section approximately four times less than the cable to be protected, would not open, but would heat up to an extent that the link insulation was damaged and the harness to which it was attached was burned. A fusible link, by SAE J156 definition is "designed to open the circuit when subjected to an extreme current overload. Its purpose is to minimize wire system damage when such an overload occurs in those circuits protected by the fusible link". Fusible link protectors are not capable of achieving a close match to the time-current characteristics of the cables to be protected.

One object of this invention is to provide an economical and effective current overload protection for motor vehicle wiring systems in the form of a fusible terminal means, which is an interface between an electrical wire or conductor and another conductor for purposes of conducting an electrical current, and to limit the maximum value of that current to a value compatible with the capability of the electrical circuit.

A second object of this invention is to provide cable crimp means for attaching the fusible terminal to a wiring cable or to other electrical conductor means for the purpose of connecting that wiring cable or other conductor means to another wiring cable or to another conductor means.

A third object of this invention is to provide a connector body or sleeve means for insulating the fusible terminal means to preclude undesirable contact with other conducting devices and electrical circuits.

A fourth object of this invention is to provide an insulation grip means for securing insulating material on the wiring cable to the fusible terminal to provide support for the cable and to prevent undesirable movement of the cable insulation.

A fifth object of this invention is to provide a fuse bridge means in the form of an area of reduced cross section of the fusible terminal means through which all electrical current conducted through the fusible terminal means will pass, and will melt when excessive electrical current is conducted through the fusible terminal.

A sixth object of this invention is to provide a bridge support means for supporting the reduced cross-sectional area of the fuse bridge means, to prevent breakage or failure of the fusible terminal due to mechanical stress and to prevent separation of the fused terminal means in the event of the reduced cross-sectional area melting.

A seventh object of the invention is to provide a fusible terminal identification means for identifying that the terminal is a fusible type.

Accordingly, there is provided a fusible terminal means for protecting an electrical cable, which has a body portion provided with cable insulation crimping means for connecting the body portion to a cable insulation. The fusible terminal further having a head portion provided with terminal connecting means, for connecting the head portion to a mating terminal connecting means. The fusible terminal means still further having a throat portion for connecting the head and body portions together and having cable wire crimping means for connecting the throat portion to a bare cable wire. The throat portion further having a fuse bridge means of reduced cross-sectional area, and a rigid insulator bridge support means connected to the throat portion across the fuse bridge means for rigidifying the fuse bridge means and for preventing the separation of the throat portion in the event of the fusing of the fuse bridge means.

The fusible terminal means is a new concept in circuit protection. The harness wire is protected by a special terminal which is very similar to a standard terminal except for an added fuse section which has a reduced cross-sectional area providing the desired maximum current limitations of the terminal. The fuse section will melt when the maximum current capabilities are exceeded. Since the terminal is materially weakened by the conductor size reduction, a bridge of high temperature insulator means is added to the fusible terminal across the reduction to strengthen the reduced cross-sectional area. The high temperature insulator may be mounted across the terminal fuse section by crimping or by molding thereon. Also, since the fusible terminal means is slightly longer than the standard terminal, the portion protruding from the harness or connector body is insulated by a band, or sleeve, or tape, or by any colored insulating material, or the like, which readily identifies the terminal as a fusible terminal means in the harness assembly.

The fusible terminal means simplifies the electrical wiring system by eliminating the fusible link and its associated mounting and wiring hardware, which is also a cost and space savings.

Thus, the fusible terminal means, combines the functions of a fusible link and a standard terminal, and provides an effective and economical protection for electrical wiring systems which were previously protected by fusible link means.

Since the fuse bridge means is of a very short length, there is very little voltage drop across the reduced section of the fusible terminal means, and there is but little electrical resistance so that the fusible terminal means does not generate any appreciable amount of heat when carrying a normal load.

The fusible link means provides increased protection against electrical short circuits by protecting the electrical circuit at the power source.

Figure 2:
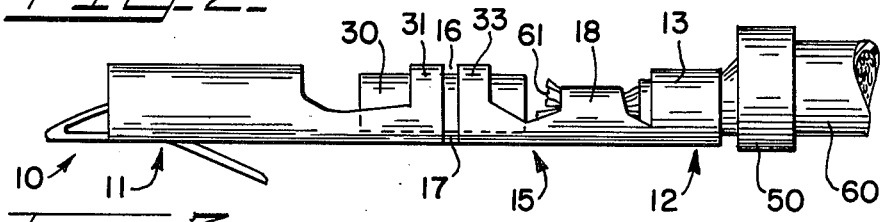
Figure 3:
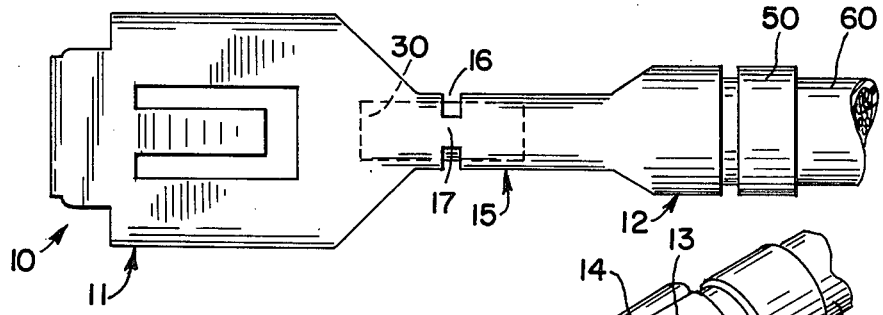

With reference to the various figures of the drawing there is shown in:

FIG. 1, a top view of a female blade type of fusible terminal means;

FIG. 2, a side view of the FIG. 1 embodiment;

FIG. 3, a bottom view of the FIG. 1 embodiment; and

Figure 4:
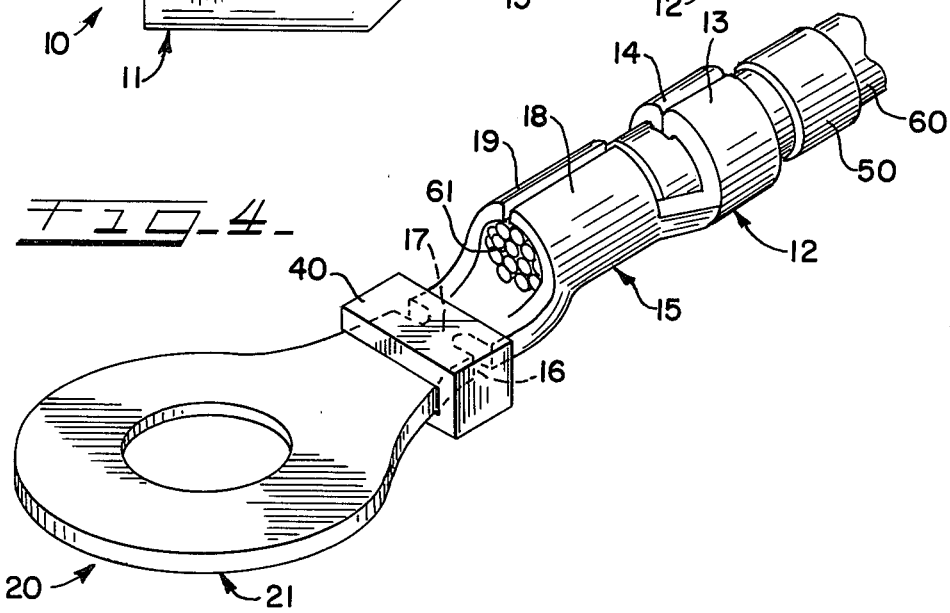

FIG. 4 an alternate embodiment of a fuse bridge and bridge support means incorporated on a ring type of fusible terminal means.

In FIGS. 1 through 3 there is shown various views of a female blade type of fusible terminal means 10, and in FIG. 4 there is shown a ring tongue type of fusible terminal means 20. It is to be understood that the head portion 11 or 21 may be of any form of terminal connector such as spade tongue, ring tongue, bullet, male quick connector, or hook-tongue.

The common elements between the FIG. 1 and FIG. 4 embodiments are the body portion 12, which is provided with wire insulation grips or cable insulation crimping means 13 and 14, a throat portion 15, which connects the body portion 12 to the head portion 11 or 21, a fuse bridge means 16 having a reduced cross-sectional area 17, and bare wire grips or wire crimping means 18 and 19.

In the FIG. 1 embodiment a cylindrical insulator bridge support means 30 is connected across the fusible bridge means 16 by insulator crimp means 31, 32, 33, 34. The cylindrical insulator bridge support means 30 add rigidity to the reduced cross-sectional area 17 and prevents the head portion 11 from separating from the body portion 12, in the event that the fuse bridge means 16 melts or fuses.

In the FIG. 4 embodiment a rectangular box or block insulator means 40 is molded onto the throat portion 15 across the fuse bridge means 16. The block insulator means 40 adds rigidity to the reduced cross-sectional area 17.

An insulating tube, not shown, may be slipped over the body portion 12, of each embodiment, as an insulation for this portion, since the fusible terminal means is slightly longer than a standard terminal. In place of an insulating sleeve, there may be provided a color code band 50 around the wire or cable insulation 60 which identifies the terminal as a fusible terminal means 10 or 21. As shown in FIGS. 1 and 4, the insulation of the cable 60 is stripped back exposing the bare wires 61, which are crimped by the crimping means 18 and 19 to the throat portion 15 of the fusible terminal means 10 and 20, and the cable insulation 60 is connected to the body portion 12 by means of the wire insulator grips 13 and 14.

What is claimed is:

1. A fusible terminal means having a body portion provided with cable insulation crimping means for connecting the body portion to a cable insulation, a head portion provided with terminal connecting means for connecting the head portion to a mating terminal connecting means, a throat portion connecting the head and body portion together and having cable wire crimping means for connecting the throat portion to a bare cable wire, the throat portion further having a fuse bridge means of reduced cross-sectional area, and a rigid insulator bridge support means connected to the throat portion across the fuse bridge means for rigidifying the fuse bridge means and for preventing the separation of the head portion from the body portion in the event of fusing of the fuse bridge means, the rigid insulator bridge support means comprising a cylindrical insulator connected across the reduced cross-sectional area by axial spaced apart insulator grip means on the throat portion.

2. A fusible terminal means according to claim 1 wherein the insulator grip means comprise two pairs of axially spaced apart crimping fingers on opposite sides of the reduced cross-sectional area adapted to be crimped around the cylindrical insulator.

3. A fusible terminal means according to claim 2 wherein a band of color coated insulating material is connected to the cable adjacent the body portion of the fusible terminal means for insulating the body portion and identifying the terminal means as fusible.

4. A fusible terminal means according to claim 3 wherein the cable crimping means comprise a pair of gripping fingers adapted to be crimped to the cable insulation, and the cable wire crimping means comprise a pair of wire gripping fingers adapted to be crimped to the bare cable wire.

* * * * *